US008539727B2

(12) United States Patent
Lui

(10) Patent No.: US 8,539,727 B2
(45) Date of Patent: Sep. 24, 2013

(54) MECHANICALLY-HELD TILE

(76) Inventor: Sun Wah Lui, Hong Kong (HK)

( * ) Notice: Subject to any disclaimer, the term of this patent is extended or adjusted under 35 U.S.C. 154(b) by 359 days.

(21) Appl. No.: 12/896,919

(22) Filed: Oct. 4, 2010

(65) Prior Publication Data

US 2011/0113713 A1 May 19, 2011

Related U.S. Application Data

(60) Provisional application No. 61/262,628, filed on Nov. 19, 2009, provisional application No. 61/319,114, filed on Mar. 30, 2010.

(51) Int. Cl.
*E04F 13/08* (2006.01)

(52) U.S. Cl.
USPC ..... 52/384

(58) Field of Classification Search
USPC ..... 52/177, 385, 387, 384, 392, 389, 52/391
See application file for complete search history.

(56) References Cited

U.S. PATENT DOCUMENTS

| | | | | | |
|---|---|---|---|---|---|
| 3,594,969 | A * | 7/1971 | Kantorowicz | 52/392 |
| 3,827,818 | A * | 8/1974 | Ruyters | 404/33 |
| 4,654,245 | A * | 3/1987 | Balzer et al. | 428/52 |
| 4,663,903 | A * | 5/1987 | Ellingson, Jr. | 52/181 |
| 5,170,601 | A * | 12/1992 | Geisen et al. | 52/177 |
| 5,205,091 | A * | 4/1993 | Brown | 52/126.6 |
| 5,323,575 | A * | 6/1994 | Yeh | 52/177 |
| 5,362,560 | A * | 11/1994 | Ehrhart et al. | 428/343 |
| 5,437,934 | A * | 8/1995 | Witt et al. | 428/537.1 |
| 6,343,451 | B1 * | 2/2002 | Chih et al. | 52/390 |
| 6,694,691 | B2 * | 2/2004 | Ku | 52/403.1 |
| 6,802,165 | B1 | 10/2004 | Passeno | |
| 2006/0080910 | A1 * | 4/2006 | Cornia | 52/177 |
| 2007/0039267 | A1 * | 2/2007 | Swanson | 52/391 |
| 2008/0184646 | A1 * | 8/2008 | Alford et al. | 52/582.1 |
| 2010/0257801 | A1 * | 10/2010 | Anderson | 52/391 |
| 2011/0041439 | A1 * | 2/2011 | Reid | 52/389 |

FOREIGN PATENT DOCUMENTS

| | | | |
|---|---|---|---|
| GB | 1089846 | A | 11/1967 |
| WO | 2005014285 | A1 | 2/2005 |
| WO | 2006045197 | A1 | 5/2006 |

OTHER PUBLICATIONS

International Search Report & Written Opinion of PCT/CN2010/001844 dated Nov. 24, 2011.

* cited by examiner

*Primary Examiner* — Christine T Cajilig

(57) ABSTRACT

A method of making a mechanically-held tile is disclosed by providing a tile having a durable surface, an underside and an anchoring region, locating the tile in a mold, and injecting a polymer into the mold to form a substrate with an integral coupling region. Alternatively, a substrate can be provided in addition to the tile; the injected material mechanically anchors the substrate to the tile. A surrounding grout gasket can also be formed during injection. Injections can be consecutive or concurrent to tailor the properties of the substrate, grout gasket and other layers or regions. Also disclosed is a multi-part tile made by such a process, and a tile with intrinsic manufacturing deviations compensated by a grout gasket. The tile can be interconnected via the coupling regions with other surface-covering materials.

19 Claims, 11 Drawing Sheets

MECHANICALLY-HELD TILE

RELATED APPLICATIONS

The present application claims the benefit of U.S. Provisional Applications 61/262,628 and 61/319,114, the disclosures of which are hereby incorporated by reference.

TECHNICAL FIELD

The present invention relates generally to tiles for covering surfaces, and more specifically to composite tiles with the composite elements mechanically connected together, and improved methods for manufacturing said tiles.

BACKGROUND

Tiles have been used to cover different surfaces for a long time. They are used in different environments to provide different functions, for example as a hard wearing surface, decoration or water proofing. The size, shape, material and surface finishing of each tile installed in a tiling array can all be varied according to the use requirements. A tiling array as defined herein is an array of tiles in various shapes, sizes and materials that fit together to continuously cover a surface.

One type of installation is where a surface is covered in a tiling array composed of the same general type of tile, although certain characteristics such as the colour and size may be varied to produce visually appealing decorative patterns. Precise alignment of the tiles is required to achieve the visual effect.

Another type of installation is where a tile is installed as a decorative insert in another floor covering array, such as hardwood flooring or parquets where adjacent flooring planks are connected together with an interlocking tongue and groove system. Currently it is difficult to install certain types of tile, such as stone or metal tiles, as decorative inserts because such types of tiles lack coupling regions.

Traditional tiles are typically affixed to surfaces by a labour-intensive method in which each tile is individually placed on the surface and affixed thereto using adhesive between an underside of the tile and the surface. This process is repeated until the surface is covered in an array of tiles. As these traditional tiles do not have an integral positioning mechanism, the alignment process depends on the skill of the installer, who can optionally use spacing inserts or other tools. Significant time, usually at least one day, is required to allow the adhesive to harden before any grout application process can start, such that the total time is at least 2 days. This has made the installation cost high for small jobs.

A further complication arises during installation because traditional tiles have significant dimensional variance: 2 mm is not unusual, and in some cases up to 5 mm. To accommodate the variance, installers have to leave space between the tiles. The gap between the tiles is filled in a manual labour-intensive process with a material known as grout, which hardens after application. The final appearance depends on the skill of the installer applying the grout, and installation by a non professional is tedious and prone to producing an unappealing finish. The composition of the grout is varied according to the use requirement, for example in wet environments the grout provides water proofing to prevent permeation of water to the underside of the tile. The grout is usually flexible enough to accommodate any thermal expansion.

If additional layers, such as cushioning or underlay layers, need to be installed then each tile will have to be connected to the layer, which further lengthens the installation process.

There is therefore a need to manufacture a tile which can be easily and quickly installed by a non-professional and which overcomes the above drawbacks.

Various attempts have been made to produce a tile which can be readily installed in a reduced amount of time, with minimal need for manual alignment of each tile.

One example is the Snapstone® tiling system (disclosed at www.snapstone.com) produced by the Snapstone Co. LLC. This utilizes a porcelain tile which is glued to a substrate having a push fit interlocking mechanism arranged along its edges which locks adjacent tiles together. After installing the Snapstone® tiles on a floor in a floating tile installation, the gaps between the interlocking tiles are filled with grout manually.

Although an improvement on traditional tiles, the Snapstone® tiling system is a partial solution because the installation process still requires the grouting step. Additionally, the Snapstone® tile also requires the use of adhesive to fasten the tile to the substrate. This is a significant drawback because the adhesive compound can fail in use, especially through moisture damage.

Another partial solution is disclosed in U.S. patent application Ser. No. 11/701,777, the contents of which are hereby incorporated by reference. A substrate which is formed in an injection moulding process, preferably Reaction Injection Moulding ("RIM"), is attached to a pre-formed tile to form a laminated groutless tile. The means of attachment is by bonding between the substrate and tile, such as by use of an adhesive. The edges of the substrate of the resulting laminate tile are then linear milled parallel to the edges of the tile to produce coupling members.

Manufacturing a tile using reaction injection moulding is relatively slow, taking between 10 and 20 minutes to make a single tile. Additionally, use of RIM results in the dimensions of the end product varying from the designed dimensions due to dimensional changes during curing. This and the material used result in any sealing effect with adjacent substrates being sub-optimal.

The process of milling after moulding disclosed in U.S. patent application Ser. No. 11/701,777 increases the manufacturing cost and time, wastes material and space, and places restrictions on the precision and types of coupling members that can be made.

In use, the tile of U.S. patent application Ser. No. 11/701,777 suffers from substrate-to-tile debonding due to failure of the adhesive.

The invention as claimed herein overcomes some or all of the above mentioned drawbacks and provides an improved method of manufacture with lower production cost.

SUMMARY

It is an objective of the presently claimed invention to provide an improved method of manufacturing a mechanically-held tile wherein the process of directly mechanically connecting a substrate to a tile occurs during an injection process. Preferably the process of forming an interlocking system for engagement with other tiles also occurs during the injection process. The tiles thus manufactured can be placed on a subfloor in a floating tile array which can be readily removed and reused, such as an interconnecting tile array.

Herein is disclosed a method of manufacturing a mechanically-held tile, comprising providing a tile having a durable surface, an underside and an anchoring region, locating the tile in a mould, providing a substrate in the mould, and injecting a first flowable material into said mould which flows into contact and mechanically engages with the anchoring region, the said first flowable material solidifying into a retaining member which exerts a holding force on the tile and the substrate.

Tile is defined herein as a piece of material with a definite size that is usable to cover surfaces for aesthetic and/or functional purposes. It can be made from any material, for example ceramic, porcelain, natural stones of all kinds, marble, granite, limestone, sandstone, slates, artificial stone of all kinds, made with cement base or resin base, wood, plastic of all kinds, fiber board, cement, laminates, metal, glass, resin, leather, etc.

The claimed tile of the invention can have any size or shape provided it can form continuous covering of a surface when arranged together with others in a tiling array, including for example tiles in the same geometric shapes, squares, rectangles, hexagons, or any other shapes that complement each other.

A wide variety of coupling regions on the substrate may be used that facilitate connection with the coupling regions of other tiles or surface-covering materials. The coupling region is preferably provided on at least one lateral side of the substrate. The coupling region can also be partially enclosed within an underside of the substrate, facilitating easy insertion of separate coupling members. The coupling region should preferably vertically and horizontally connect a tile to an adjacent tile.

In exemplary embodiments, the coupling regions comprises cooperating male and female members, such as hook and lock, tongue and groove, interlock and snap buttons. Either or each type of members can be located along all, some or just one of the edges of the substrate in a distribution determined by the tiling system. In other embodiments such as temporary tiling arrays which are frequently re-used, only female members are provided, with removable double ended male members being inserted into some of the female members after manufacture according to the claimed invention. The above examples are just exemplary embodiments and it will be understood that a wide variety of alternative embodiments can be used. In other embodiments, the coupling members may not be formed: the composite or self-grouting tile produced will be readily layable with other similar tiles. In all cases, the tiles of the claimed invention can be laid in a floating array or affixed to the subfloor.

In exemplary embodiments, the injection system used is the insert moulding system wherein one or more components of the tile are located within the mould prior to injection in the positions relative to each other that these components will adopt in the mechanically-held tile.

In certain embodiments, providing the substrate is achieved by injecting a first flowable material, which solidifies to form said substrate integrally with said retaining member, said substrate further comprising an integral coupling region for connecting the mechanically-held tile with an adjacent coupling region.

In other embodiments, the substrate having a coupling region is provided in the mould, and the injecting comprises injecting a first flowable material into the mould which both engages an engagement region provided on the substrate and the anchoring region, and solidifies to form the retaining member. The substrate may be made of any suitable material including for example plastic, resin, metal, wood and laminates.

In yet other embodiments, the substrate is provided by injection of a second flowable material into the mould which flows into the mould forming the substrate and integral coupling region, and further comprising substantially concurrent or consecutive injection of a first flowable material to engage the anchoring region, thus mechanically anchoring the substrate to the tile by the retaining member.

The first flowable material is preferably a single common thermoplastic that is molten when heated. Preferably it sets quickly, during which it substantially maintains its volume so that shrinkage is minimized. Other materials such as resin that solidifies in by a chemical reaction in a process called Reaction Injection Molding may be alternatively used as the first flowable material. The material will flow into and fill space left in the mould.

Preferably the first flowable material is a relatively soft material capable of tightly mechanically holding the tile and substrate together. Even more preferably, when the first flowable material forms a retaining member that also functions as a grout gasket, it is waterproof and compressible but resilient when hardened, thus forming a waterproof seal between adjacent tiles when in a tiling array. The surface of the grout gasket may be patterned in the mould.

The first flowable material in certain embodiments involving concurrent injection is more than one material, so that the different desired components can have different properties and behaviors. The second flowable material where used may also have different material properties when hardened, so that different components have different properties and behaviours. For example, the first flowable material may be relatively compressible after it is set to form a grout gasket; the second flowable material may be relatively less compressible when used to form the supporting substrate. The supporting substrate provides strength and in certain embodiments connects other components such as the underlay. Preferably where a separate material is used to make the supporting substrate it is made of a low cost material. Other substantially concurrent or consecutive injections can be performed using other flowable materials to form functional layers or regions with different properties.

The material of the substrate may be one of the following thermoplastics: acrylonitrile butadiene styrene (ABS), polyethylene (PE), polypropylene (PP). Other plastics that on hardening are relatively rigid and can support the tile may be equally alternatively selected and employed by one skilled in the art without exercising any inventive activity.

The material of the grout gasket may be thermoplastic rubber (TPR). Other plastics that on hardening are relatively soft may be equally alternatively selected and employed by one skilled in the art without exercising any inventive activity.

Disclosed herein is providing the anchoring region of the tile by a surface or a step that extends from and is located generally inwardly from an outer edge of the tile. Many tiles have a suitable surface to act as the anchoring region from the original manufacturing process.

Most natural or artificial stone tiles come with a "chamfer" on all edges when they are manufactured; the original purpose is to smooth the "jagged" edges formed when stone is cut. If the tile comes with this "chamfer", then that chamfer will constitute the anchoring region as material will flow onto the chamfer, overlapping all or a portion of the periphery of the durable surface and mechanically anchoring the substrate to the tile.

Most ceramic or porcelain tiles are made by firing pressed clay; when such clay is pressed in a pressing mold, the top of the tile is usually smaller than the base of the tile; such difference in dimension is called "rebate" which allows the pressed clay to be released from the press mold. If the tiles comes with such "rebate", nothing need to be done as material will flow onto the rebate.

In the event that the tile does not have the chamfer or rebate when it is originally manufactured, artificial surfaces can be made on the upper surface of the tile to form the anchoring region in lieu of the chamfer or rebate. Where there is a chamfer or rebate but it is insufficient, it can be modified to provide a suitable anchoring region.

Also disclosed herein is an anchoring region of the tile provided by machining the outer edge of said tile or machining a recess in the underside of the tile.

In certain embodiments the anchoring region is formed by cutting a step or an angle on at least two or all sides of the tile by cutting tools. This method is also used if the tile is cut from a bigger tile or slab as the cut tile will naturally lack a chamfer or rebate on some or all sides. Various types of angles and steps can be employed that extend inwardly from the edge of the tile and provide a sufficient surface for the flowable material to mechanically grip. The anchoring region may have a horizontal component of about 1 mm measured from the tile edge, and the total width of the grout gasket may be about 2 mm, such that about 1 mm of the grout gasket overlays the 1 mm extent of the anchoring region. The extent of the anchoring region is selected based on the materials used to provide sufficient fixing, balanced against aesthetic considerations of the visible extent of the grout gasket in plan view. Preferably the anchoring region extends continuously around the whole periphery of the tile.

When the periphery of the durable surface is not accessible, for example when a grout gasket is not required, the anchoring region is machined or molded during tile formation in an accessible area such as the underside of the tile. Various types of recess can be employed that extend generally away from the plane of the underside and provide a sufficient surface for the flowable material to mechanically grip. This has the advantage that the tile can be securely attached mechanically, and may be optionally employed where additional mechanical anchoring is required. The size of each anchoring region on the underside is minimized in order to minimize any effect on the tile's strength. More anchoring regions on the underside may be provided when greater mechanical anchoring is needed.

In certain embodiments where the tile is disposed directly on the substrate, the substrate is provided with engagement regions that the flowable material flows into and engages with such that on solidifying to form the retaining member it mechanically holds the substrate and tile together. The engagement regions can take several forms. At the simplest, an underside of the substrate may constitute the engagement region. In other embodiments, spaced protrusions extending towards the underside of the tile and generally perpendicular to a plane of the substrate may constitute the engagement region. In other embodiments, one or more through-channels in the substrate provide access to engagement regions on an underside of the substrate. Surface gripping features may be provided on the engagement region to enhance the mechanical engagement. Preferably a plurality of through-channels are provided on the substrate so that the flowable material can flow into the channels and join up to form an interconnected structure disposed on and preferably flush with the underside of the substrate. The areas where the interconnected structure contacts the underside may comprise the engagement regions. The interconnected structure in some embodiments is an underlayment layer, which may be resilient to provide cushioning. The interconnected structure may have a grid arrangement. Preferably the channels are provided in a peripheral zone of the substrate and the first flowable material flows around a peripheral region of the tile to form a grout gasket. Preferably the interconnected structure when formed grips the substrate across a substantial portion of the underside of the substrate.

In some embodiments the substrate may be provided with a lip around its periphery extending substantially perpendicularly away from the plane of the substrate in one or both substantially perpendicular directions. The through-channels may be formed in said lip. The tile may be directly arranged on the substrate so that the flowable material flows around a vertical portion of the edge of the tile to form a rim and onto an anchoring region of the tile, but ingress between the tile and substrate is restricted. Preferably where protrusions or a lip is provided the protrusions or lip mechanically hold the tile at a minimum number of fixing points to restrict lateral movement, such as at each corner of the tile. All of the arrangements of the aforesaid engagement regions may be combined in compatible forms.

It is a further objective to provide an easy to install tile that eliminates the need for grout during installation.

It is a further objective to manufacture a tile with a very high dimensional reproducibility and reduces the need for subsequent calibration or machining.

By locating the tile in the mould and injecting a material which surrounds the periphery of the tile the dimensional variance is substantially reduced. The dimensional variance of a tile may exist in one, two or three dimensions corresponding to the width, length and thickness, and may vary across the tile as well as from tile to tile. Each can be compensated separately, depending on the position of the tile and design of the mould. For example, the thickness variation can be compensated without compensating the width and length by arranging for no flowable material to flow around the periphery of the tile. A tile with thickness compensated will have a substrate of variable thickness but the resulting composite tile will have a uniform height and can be laid flat with other tiles presenting a substantially co-planar surface. By compensating the variation to produce uniform tiles, the tiles may be aligned and spaced quickly on a surface, and form an array of level tiles.

Herein is disclosed a grout gasket formed from the first or second flowable material extending outwardly from one or more sides of the durable surface. The retaining member may function as the grout gasket.

Herein is further disclosed a grout gasket formed from the first or second flowable material which at least partially encapsulates the lateral sides and the anchoring region of the tile.

Use of a grout gasket also eliminates the need for precise positioning of the tile within the mould, provided that the flowable material can mechanically engage with the anchoring region.

In certain embodiments, one or more additional components selected from the group of strengthening ribs, a cushioning layer, a ventilation layer, a conduit layer, an underlayer and an acoustic layer are provided and fixed to the tile whilst the tile is in the mould. These functional layers may be located where required, such as on the underside of the durable surface or substrate. To prevent the tile from sounding hollow when used in a floating installation, it is preferred to provide an acoustic layer such as a layer of silicone gel on the underside of the durable surface. The functional layers may be attached by any means, but are preferably mechanically held in place by a force exerted between the durable surface and substrate by the retaining member.

Herein is further disclosed a mechanically-held composite tile comprising a tile having a durable surface, an underside and an anchoring region, a substrate disposed proximal to or in close contact with the underside, and a looping member as a grout gasket extending around a periphery of the tile and mechanically engaging the anchoring region, with at least a portion of the looping member extending into contact with an engagement portion of the substrate to exert a holding force on the substrate and tile.

The substrate may have an integral coupling region for connecting the tile with an adjacent coupling region. Tiles having such a coupling region are also referred to herein as interconnectable tiles. Tiles without an integral coupling region will also have high dimensional precision and have a grout gasket, and as such may be placed directly together or attached to a surface by known methods such as with adhesive or mounting adhesive pads.

An acoustic layer may be disposed directly on the underside of the tile. Other layers may be also provided between tile and substrate.

Preferably the looping member is formed in an injection process, and is made of a compressible but resilient material, capable of mechanically gripping and holding the tile and substrate together by itself.

The anchoring region of the tile may be provided as discussed above.

The engagement region may be provided by an underside of the substrate accessed by through-channels in the substrate.

The looping member may have portions which comprise an interconnected underlayment structure in engagement with the engagement region, which mechanically grips the substrate.

Herein is also disclosed a self-grouting tile for a self-grouting tile system, each self-grouting tile comprising a tile portion having design dimensions of a width x, a length y, and a thickness z, and actual dimensions of a width $x+\delta_x$, a length $y+\delta_y$, and a thickness $z+\delta_z$, where $\delta_x$, $\delta_y$, and $\delta_z$ each represent a manufacturing deviance from x, y, and z, respectively, and $\delta_x$ ranges from $-0.01x$ to $0.01x$, $\delta_y$ ranges from $-0.01y$ to $0.01y$ and $\delta_z$ ranges from $-0.05z$ to $0.05z$, the self-grouting tile further including a mechanical anchoring region formed therein; a tile support structure surrounding all edges of the tile portion to create a tile self-grouting portion, the tile self-grouting portion integrally formed with a tile base support portion, the tile self-grouting portion having a design width and length of $t_x$ and $t_y$ respectively such that, in the x-y horizontal plane of the tile portion the design self-grouting tile dimension is $x+t_x$ and $y+t_y$, and due to the manufacturing deviance of the tile, the actual self-grouting portion width in the x direction is $t_x-\delta_x$ and the actual length in the y direction is $t_y-\delta_y$, the tile base support portion of the tile support structure having a vertical design thickness of $t_z$, and an actual thickness of $t_z-\delta_z$ such that the self-grouting tile design dimensions in the x, y, and z directions are substantially achieved regardless of any manufacturing deviance of the tile portion; and the tile support structure self-grouting portion or the tile base support portion mechanically engaging with the tile through the mechanical anchoring region in the tile.

The tile support structure of the self-grouting tile may further include coupling regions as discussed above for facilitating interconnection with adjacent self-grouting tiles.

Other aspects of the invention are also disclosed.

The claimed method of the invention thus produces a tile as claimed faster than a tile produced by existing methods. It does not require adhesive to affix the composite parts of the tile together, nor does it need to be milled, reducing the number of post-processing steps.

The claimed tile also has greater dimensional uniformity due to the compensation of the tile's intrinsic variation in one or more dimensions, and can thus be laid fast and accurately.

BRIEF DESCRIPTION OF DRAWINGS

Embodiments of the invention are described in more detail hereinafter with reference to the drawings, in which.

DETAILED DESCRIPTION

Improved methods of making a mechanically-held tile in an injection process using a pre-formed component are disclosed herein.

In the following description, the methods of manufacture of the mechanically-held tile and the like are set forth as preferred examples. It will be apparent to those skilled in the art that modifications, including additions and/or substitutions may be made without departing from the scope and spirit of the invention. Specific details may be broadly described so as not to obscure the features of the invention; however, the disclosure is written to enable one skilled in the art to practice the teachings herein without undue experimentation.

Figure 1:
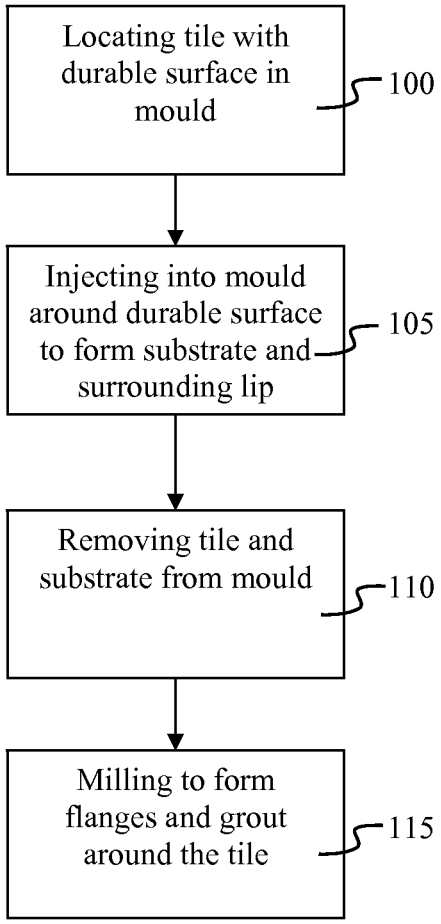
Prior art FIG. 1
FIG. 1 shows the manufacturing steps of the prior art in U.S. patent application Ser. No. 11/701,777.

FIG. 1 shows four steps of a prior art method of manufacturing a tile with an interconnecting mechanism. Firstly, a standard tile is located 100 in a mould with its durable surface flush against one of the surfaces of the mould. Then, a flowable material is injected 105 into the mould, flowing around the tile and into spaces left in the mould between tile and mould walls to form the substrate and an oversized surrounding lip. The tile and substrate are joined by non-mechanical methods. Thirdly the tile with substrate is removed from 110 the mould and finally a flange is milled 115 in the substrate where it protrudes from the sides of the tile to form an interconnecting mechanism.

Figure 2:
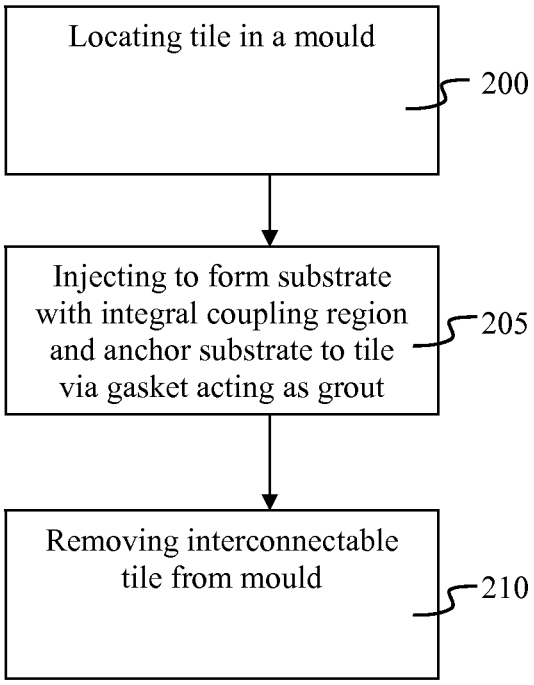
FIG. 2 shows the manufacturing steps according to an embodiment of the claimed invention.

FIG. 2 shows an improved method according to the current invention, which has a reduced number of steps. A tile with anchoring region is located 200 first in a mould, with the durable surface flush against a surface of the mould. This is followed by injection 205 of a flowable material into the mould, flowing around the tile and into spaces between the tile and mould to form the substrate. The mould walls have a shaped surface corresponding to a negative profile of a desired coupling region, such that the flowable material flows into and abuts against the shaped surface to form the coupling region during injection. The flowable material during injection 205 flows around gaps between the mould wall and tile, into engaging contact with an anchoring region of the tile to mechanically engage it and self-anchor the substrate and tile together. The gap is about 1 mm around the periphery of the durable tile. The tile can be removed 210 from the mould when the flowable material has sufficiently hardened to form a retaining member.

Figure 3:
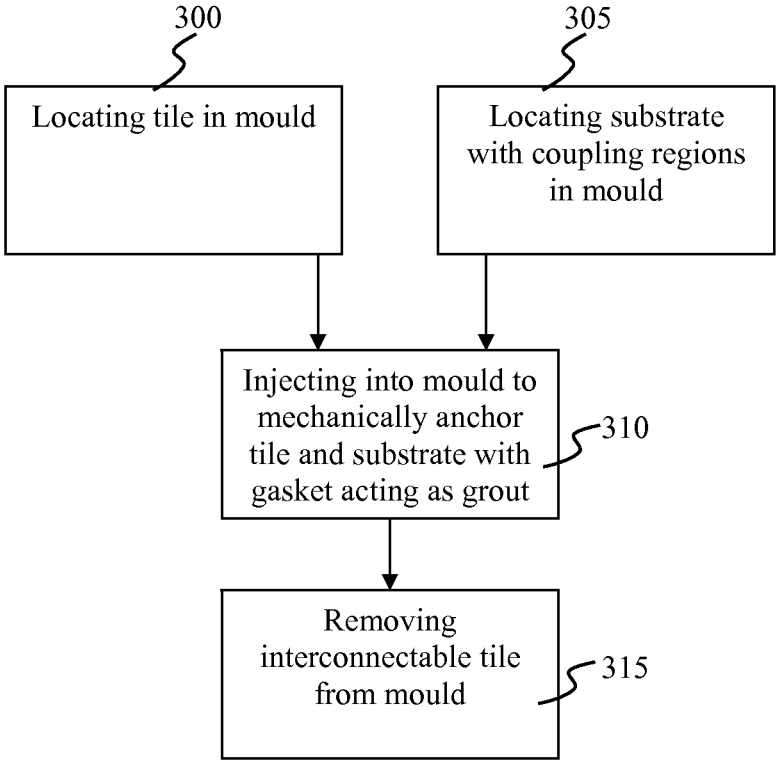
FIG. 3 shows the manufacturing steps according to another embodiment of the claimed invention.

Referring to FIG. 3, an alternative embodiment of the method in which both a tile is located 300 in a mould and a substrate with a coupling region is also located 305 in the same mould. The locating 300, 305 steps are shown at an equivalent position in time because depending on the configuration of the mould the order of placing in the mould can be varied, or carried out simultaneously. Once arranged in the mould such that the anchoring regions are fluidly accessible, a flowable material is injected 310 into the mould, flowing into the fluidly accessible regions and into engaging contact with the anchoring region on the tile and the engagement region on the substrate. The tile can then be removed 315 from the mould when the flowable material has sufficiently hardened.

Figure 4A:
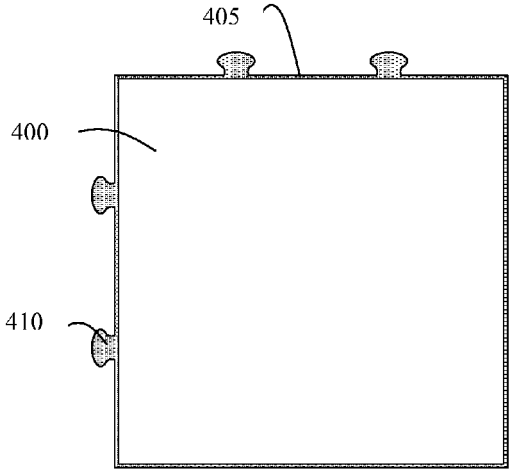
FIG. 4*a*-4*d* show different views of an embodiment of an interconnectable tile made according to the claimed invention.

FIG. 4*a* shows a plan view of a square tile with a durable surface 400, having a grout gasket 405 formed by injection of a fluid material. The grout gasket 405 surrounds all of the edges of the durable surface of the tile. A pair of protruding male members 410 is disposed at a spaced interval on the substrate 415 (FIG. 4*b*) on two adjacent sides of each tile. The male members 410 are for cooperation with female members 420 (FIG. 4*b*) in the substrate.

Figure 4B:
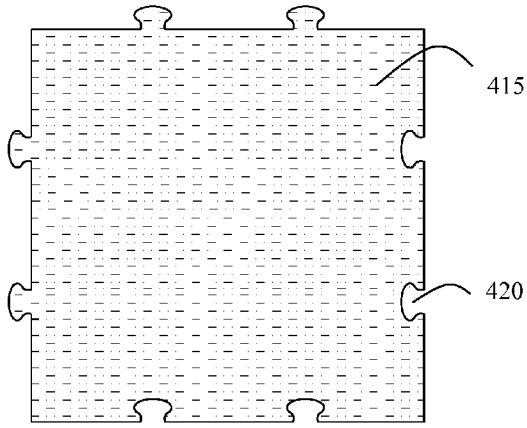

FIG. 4*b* shows an underside of the tile of FIG. 4*a* but omits the tile.

Figure 4C:
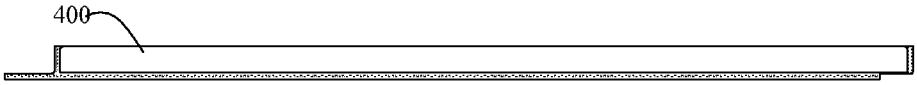
Figure 4D:
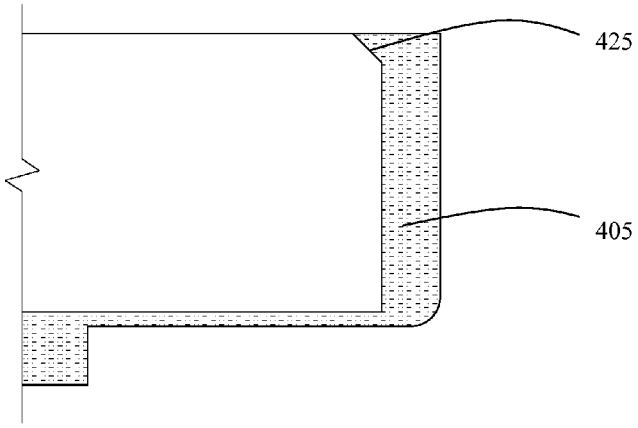

In section views FIGS. 4*c* and 4*d* it can be seen that the grout gasket 405 extends upwardly from the substrate to cover all of each lateral edge of the tile. FIG. 4*d* is an enlarged view of an edge of 4*c*, in which an inwardly sloping surface on the upper edge of the tile forms the anchoring region 425.

Figure 5A:
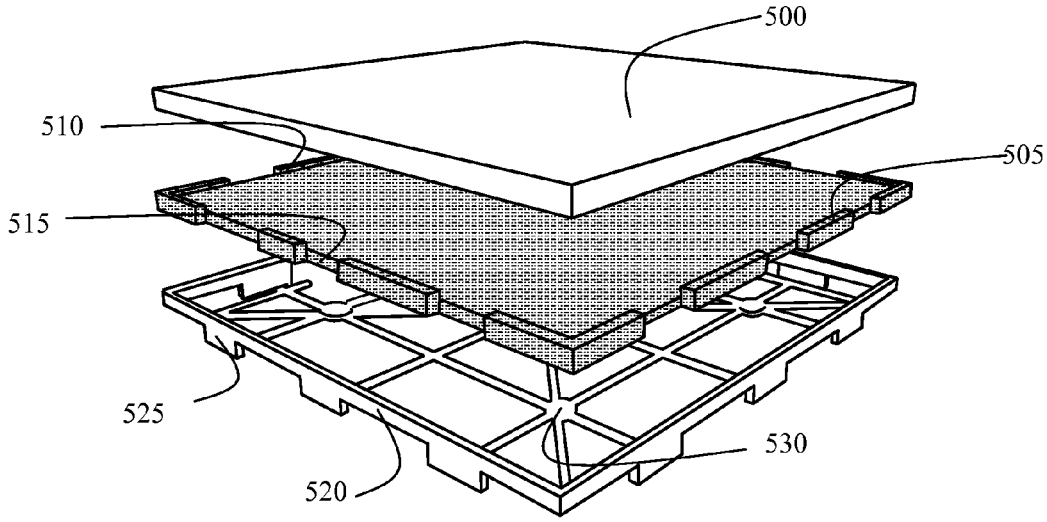
FIGS. 5*a* and 5*b* illustrate an alternative embodiment of a tile according to the claimed invention.

FIG. 5*a* shows an exploded layered view of an alternative embodiment of the tile according to the claimed invention. Tile 500 is disposed for fluid-tight contact on a substrate 505, which has a lip 510 around its periphery. Through-channels 515 are provided in the periphery of the substrate and extend through the lip. In the embodiment shown the through-channels 515 are open on one side. A grout gasket 520 forms a looping member around a peripheral region of the tile 500. Spaced protrusions 525 extend downwardly from all sides of the grout gasket 520, into and through the through-channels 515. Extending in a plane across an underside of the substrate 505 from each of the protrusions 525 is an interconnected grid structure 530, formed during the injection process.

Figure 5B:
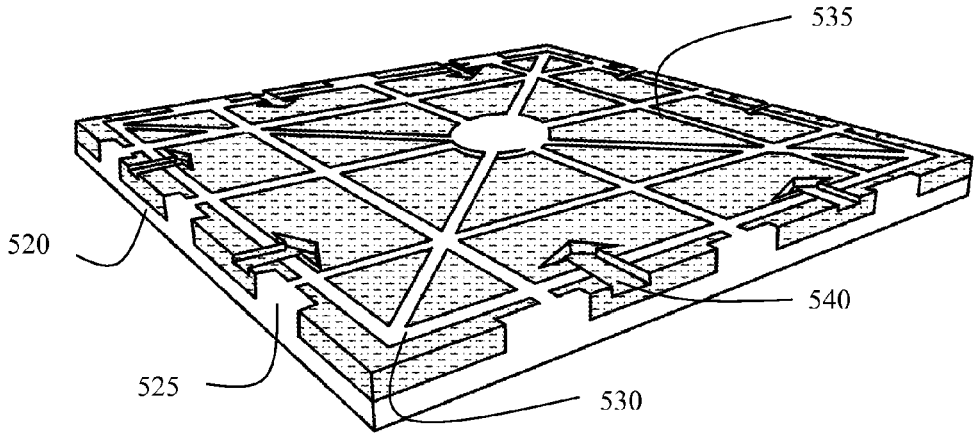

FIG. 5*b* shows a view of the underside of the finished tile of FIG. 5*a*. The interconnected structure 530 is disposed tightly on the underside 535 of the substrate. The interconnected structure generally comprises a grid, having evenly spaced intersecting lines arranged at approximately 45 and 90 degrees to each other. Reinforcement is provided where the lines intersect. A peripheral line closest to and parallel with the edges of the substrate has discontinuities where the underside 535 of the substrate has a recess, such as coupling regions 540 in the form of arrow-headed female members. A replaceable double-headed male member (not shown) can be inserted into two opposing female members on two adjacent interconnectable tiles to connect the tiles. The intersecting lines may be wholly or partially received in guideways (not shown) in the underside of the substrate. Areas of the underside of the substrate away from the guideways may be relatively recessed to minimize material usage.

The embodiment of FIGS. 5*a, b* is made by placing the substrate 505, which has the through-channels, and coupling regions 540 in the mould in sequence with the tile 500, the tile's durable surface being flush against a surface of the mould, but with its edges being spaced from the mould walls. A first flowable material plastic is then injected into the closed mould. The flow of the plastic material will vary depending on the mould design, but it will flow on a portion of the underside 535 of the substrate, and via guideways (not shown) will join up to form the interconnected grid structure 530. The regions where the interconnected structure 530 contacts the underside 535 comprise all or part of the engagement regions. The guideways may be provided in the mould wall or in the underside of the substrate. The plastic also flows through the through-channels towards the tile, and towards the sides of the tile to form the grout gasket 520. The plastic will also flow to the anchoring regions on the durable surface of the tile, and will mechanically anchor everything together after solidifying into a single piece.

Figure 6:
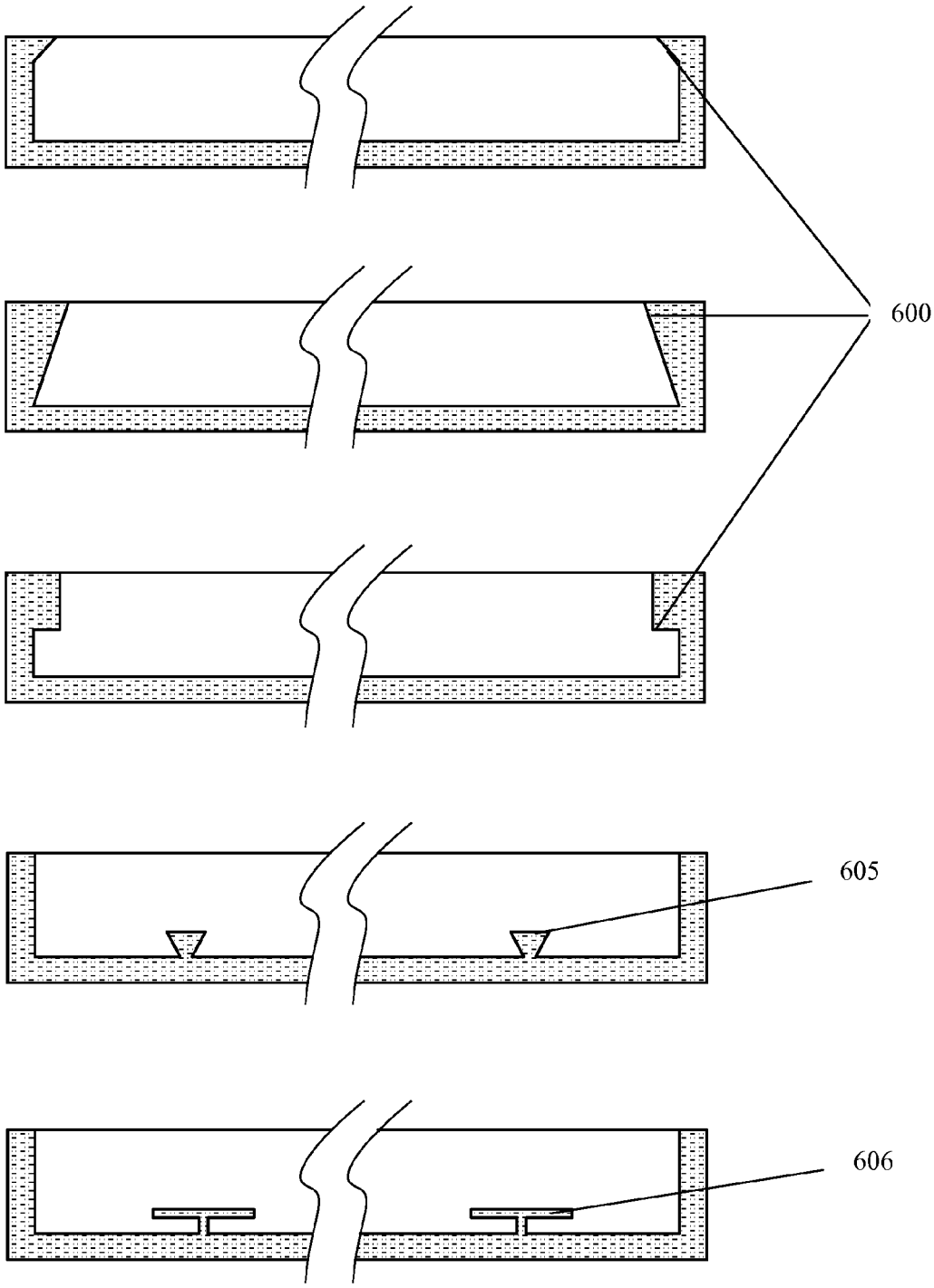
FIG. 6 shows different exemplary embodiments of forming the anchoring region on a tile according to the claimed invention.

Referring now to the top three illustrations of FIG. 6, various examples of anchoring regions 600 on an upper edge of the tile are shown. A sloping surface extending over a partial (such as a natural chamfer) or a full height (such as made by a cutting saw) of the edge or an inward step can be used, and other non-shown variants will be realizable by the skilled user. The $4^{th}$ illustration of FIG. 6 shows a tile where the anchoring region is a rebate 605 drilled or molded during tile formation into an underside of the tile. The lateral extent on the underside, distribution and depth can be varied, as can the shape and size of the rebate 605. The rebate 605 has a pinch point located towards the underside of the substrate such that once fluid material has flowed into the rebate and solidified, the solidified material cannot be removed.

Figure 7A:
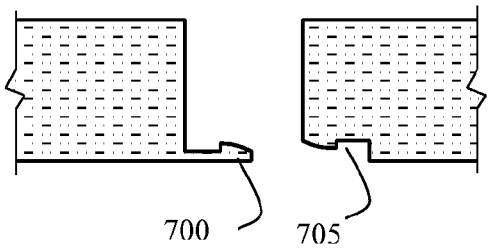
FIG. 7*a*-7*e* show different exemplary embodiments of coupling regions that can be employed with the claimed invention.
Figure 7B:
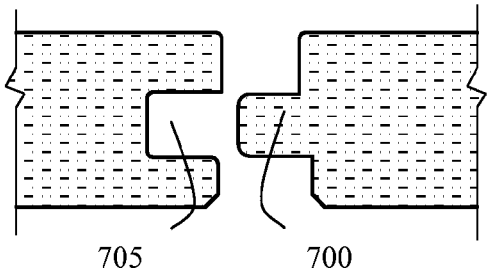
Figure 7C:
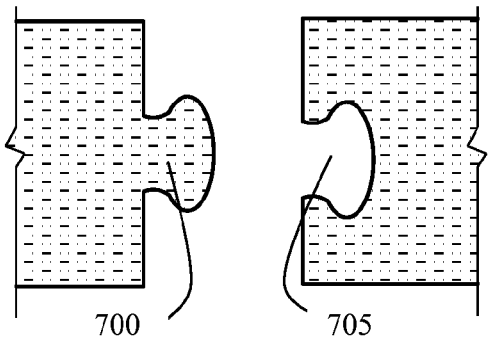
Figure 7D:
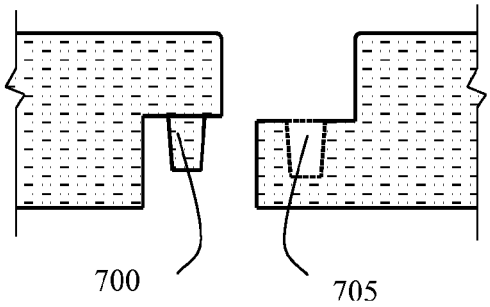
Figure 7E:
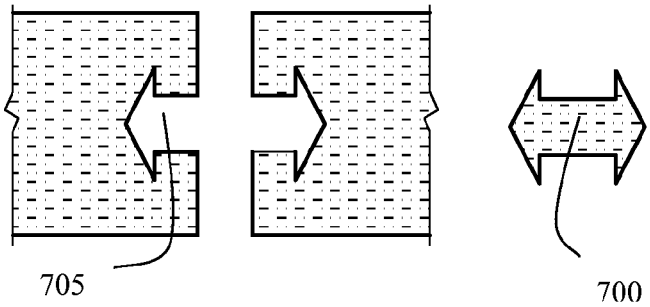

FIGS. 7*a*, 7*b* and 7*d* are side views illustrating different exemplary male 700 and female 705 coupling members for functioning as cooperating coupling regions. In FIG. 7*d* internal detail of a coupling region is also shown in dotted lines. They show hook and lock, tongue and groove, and interlock respectively. FIGS. 7*c* and 7*e* are bottom views. FIG. 7*c* shows snap buttons, whereas FIG. 7*e* shows coupling members comprising two female members and a double headed male insert as connector.

Figure 8A:
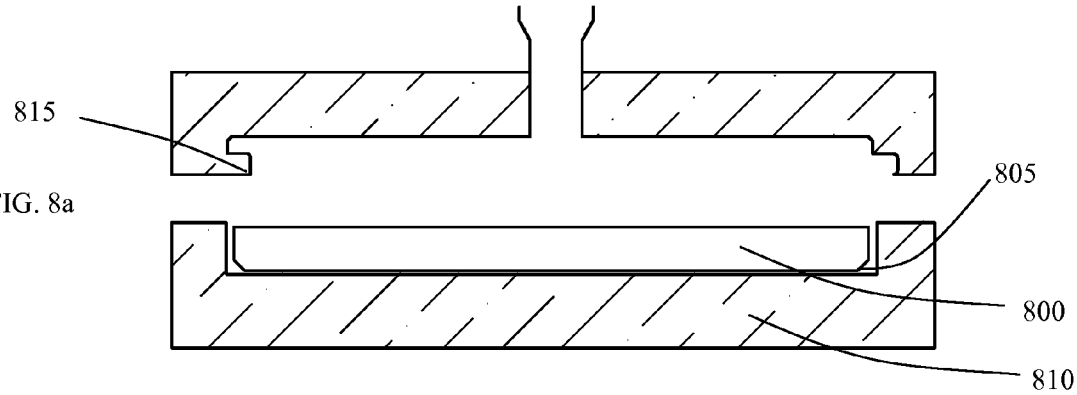
FIGS. 8*a* and 8*b* illustrate a method used to manufacture an interconnectable tile.

FIG. 8*a* shows the first step of a method according to the invention: locating the tile in a shaped mould. Tile 800 has a chamfer 805 around its periphery. Anchoring regions in the underside (not shown) may also or alternatively be used. The tile is located in the lower half of a mould 810 with the durable surface flush against a floor of the mould 810. Space is provided around the sides of the tile 800. The upper half of the mould has the female profile 815 of the desired substrate and integral coupling region.

Figure 8B:
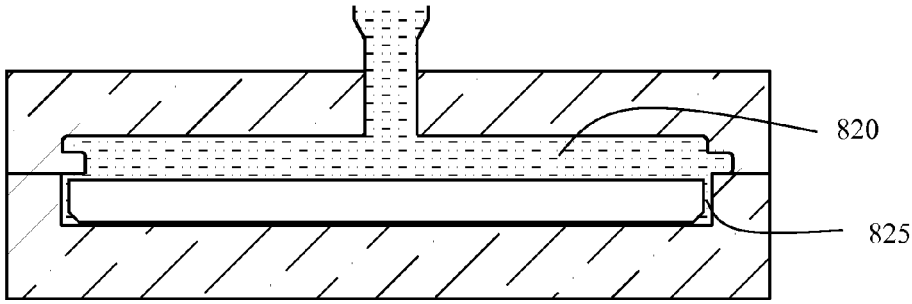
Figure 8C:
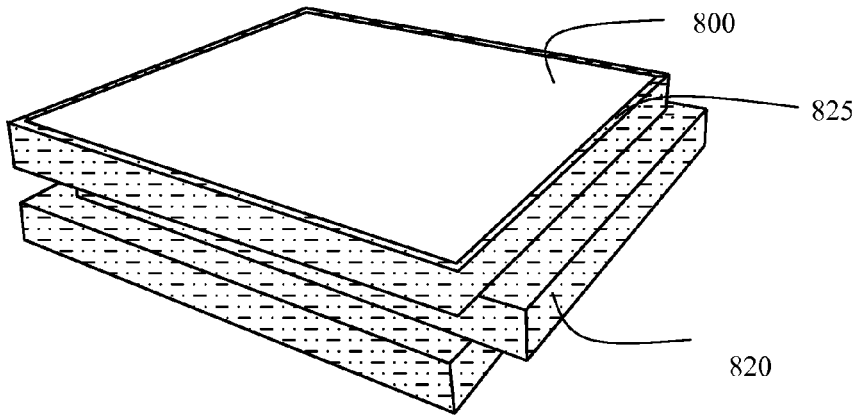
FIG. 8*c* illustrates an example of a finished tile according to the claimed invention.

In FIG. 8*b* the two halves of the mould are fluid tightly joined, and flowable material is injected to form a one-piece substrate 820 and grout gasket 825 around the tile. FIG. 8*c* shows an interconnectable tile after the injection process of FIG. 8*b* has terminated. In the exemplary embodiment of FIGS. 8*a*-8*c*, a tongue-and-groove coupling region is formed; however, it is understood that other coupling geometries, including, but not limited to, the coupling configurations of FIGS. 7*a*-7*e* can be formed by the process of FIGS. 8*a*-8*b* by selection of a corresponding mould configuration.

Figure 8D:
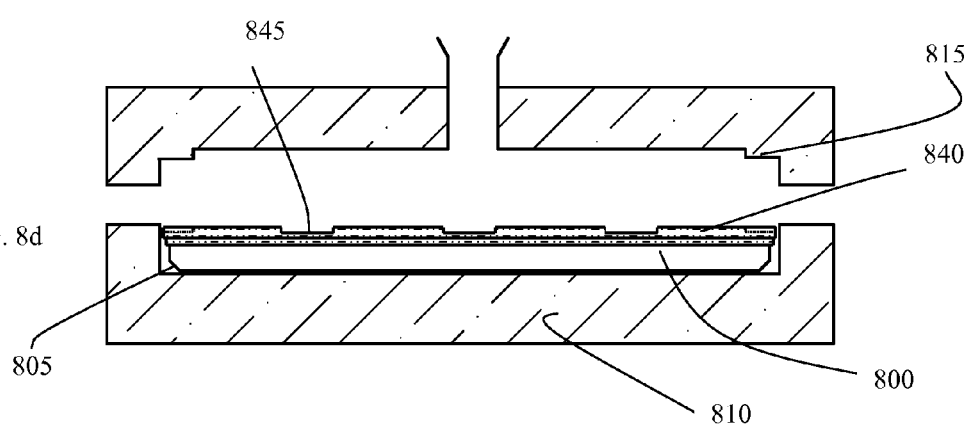
FIGS. 8*d* and 8*e* illustrate a method used to manufacture an interconnectable tile according to a further embodiment.
Figure 8E:
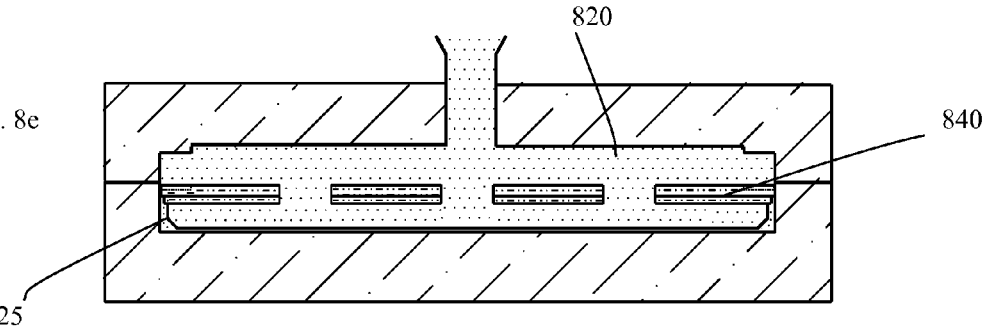
Figure 8F:
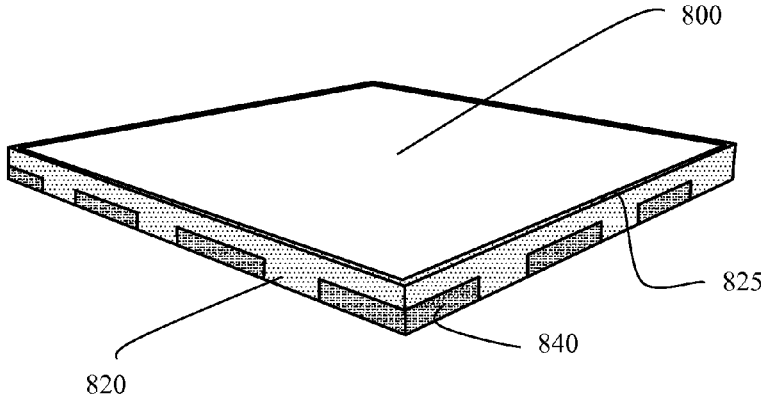
FIG. 8*f* illustrates a tile made by the method of FIGS. 8*d* and 8*e*.

FIGS. 8*d* and 8*e* depict a molding method for forming a tile with a substrate portion and a further molded portion such as the tile of FIG. 5. The tile 800 with the chamfered portion 805 is placed in the first half of the mould. Substrate 840, substantially corresponding to substrate 505 of FIG. 5, is placed behind tile 800 or alternatively is molded to tile 800 in a separate molding step. Substrate 840 includes through-channels 845 through which a polymeric material can flow. Flowable polymeric material 820 is injected into the mold to create gasket/grout portion 825 and the interconnected regions depicted in FIG. 5 (not visible in the cross-sectional views of FIGS. 8*d* and 8*e*). The finished tile of FIG. 8*f* is substantially similar to that of FIG. 5*b*. While the tile of FIG. 5*b* is configured to receive a double-headed male interconnecting element, it is understood that the process of FIGS. 8*d* and 8*e* can be used to form other interconnection structures, either male or female, through selection of the appropriate mould shape.

Figure 9A:
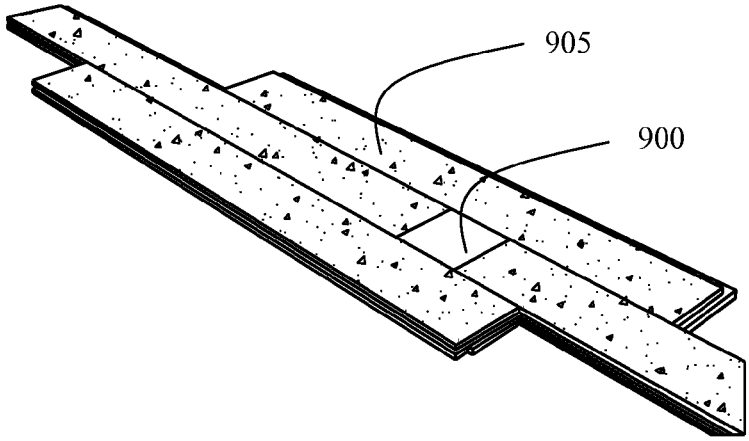
FIGS. 9*a* and 9*b* illustrate a tile according to the claimed invention installed as a decorative insert and as a parquet respectively FIGS. 10*a* and *b* illustrate the plan and cross-sectional views respectively of a tile dimensionally compensated according to the claimed invention.
Figure 9B:
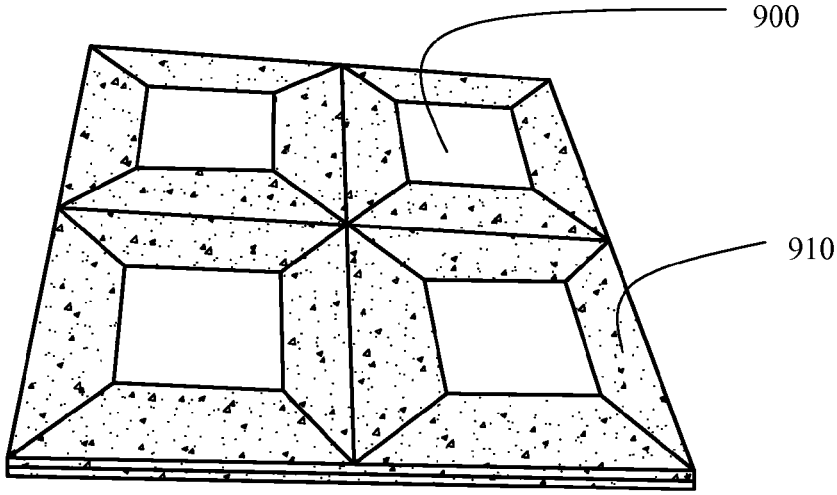

For different applications, the interconnectable tile can be installed in combination with other covering materials that already have a connecting system, for example solid and engineered wood planks, parquet systems and so on. In such cases, the coupling regions of the interconnectable tile should be capable of cooperating with those of the other covering materials to form a mating couple. Examples of other covering materials include wood planks and parquet, laminate, bamboo, etc. that come with interconnecting systems such as tongue and groove. FIG. 9*a* shows an interconnectable tile 900 in a floor covering of tongue and groove wooden planks 905. FIG. 9*b* shows an interconnectable tile 900 in a parquet array 910. Although the same reference numeral is used to refer to the tile, the tile may have various configurations and coupling regions.

Figure 10A:
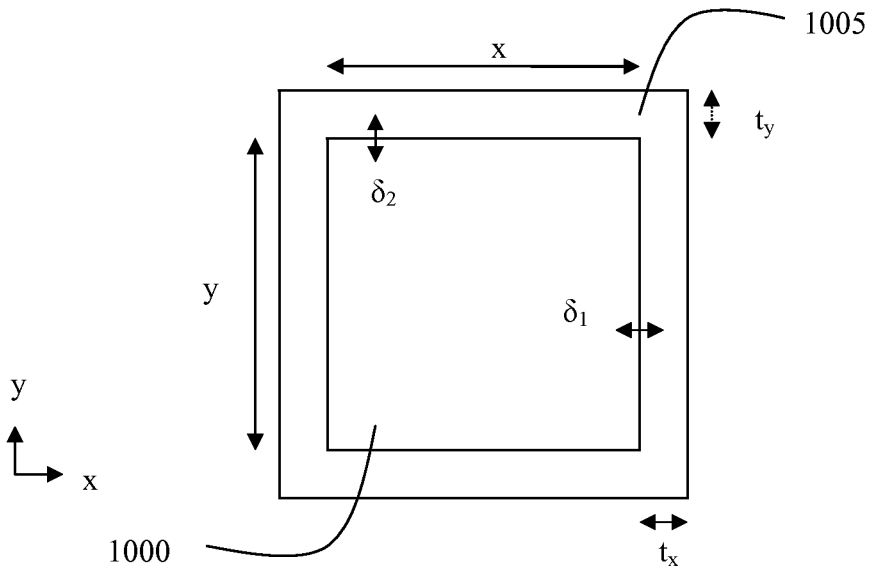

FIG. 10*a* shows a plan view of a self-grouting tile 1000 which has nominal dimensions of x and y in the length and width dimensions and manufacturing deviations $\delta_x$, $\delta_y$, in the x and y dimensions respectively. Typically, $\delta_x$ ranges from −0.01x to 0.01x and $\delta_y$ ranges from −0.01y to 0.01y The nominal design thickness of the grout is $t_x$ and $t_y$ respectively, such that, in the x-y horizontal plane of the tile portion, the nominal design self-grouting tile dimension is $x+t_x$ and $y+t_y$. However, due to the manufacturing deviance of the tile, the actual self-grouting portion width in the x direction is $t_x\delta_x$ and the actual length in the y direction is $t_y-\delta_y$. Thus the actual tile dimensions are compensated by the surrounding tile self-grouting portion 1005 such that the width is $x+(t_x-\delta_x)$ and the length is $y+(t_y-\delta_y)$ resulting in a length and width of the tile plus self-grouting portion substantially equal to the design dimensions regardless of the actual dimensions of each individual starting tile.

Similarly, the tile base support portion of the tile support structure has a vertical design thickness of $t_z$, and an actual thickness of $t_z-\delta_z$ such that the thickness is $z+(t_z-\delta_z)$.

Figure 10B:
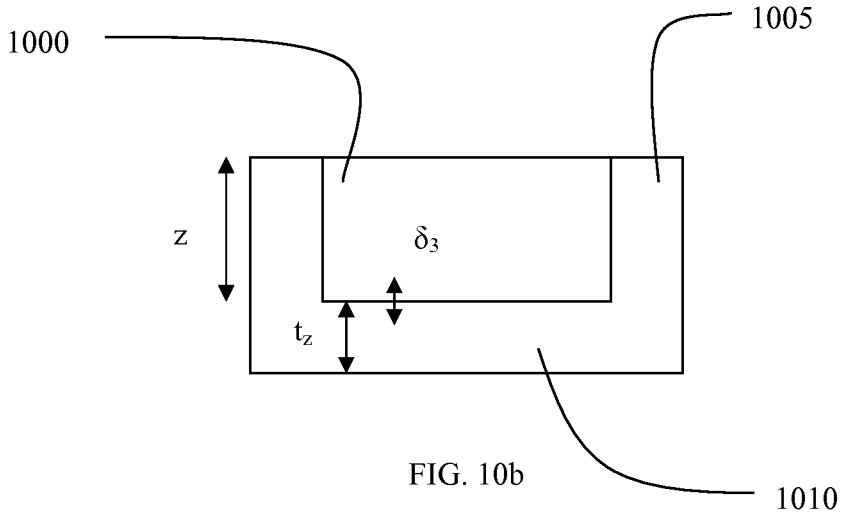

The tile self-grouting portion 1005 formed integrally with the tile base support portion 1010 (FIG. 10*b*) constitutes the tile support structure. The dimensions shown in FIG. 10 are representative only and not to scale. In a typical tile, the variation in the x and y directions is about 3 mm (1%). In the z direction it may be up to +/−0.4 mm (5%). Although not shown, the deviation may vary across the tile and therefore so will the compensation.

Thus in a particular example, if a tile of 305 mm×305 mm×8 mm, being the length, width and height respectively, the tile will come with manufacturing deviances as shown in Table 1 below.

After compensation by the tile support structure the self-grouting tile will have substantially reduced dimensional variance as shown in Table 1, with figures rounded to nearest significant place.

TABLE 1

| Dimension | Tile actual dimensions/mm | % variation | Compensated dimensions/mm | % variation |
|---|---|---|---|---|
| X | 305 +/− 3 | 1 | 307 +/− 0.1 | 0.04 |
| Y | 305 +/− 3 | 1 | 307 +/− 0.1 | 0.04 |
| Z | 8 +/− 0.4 | 5 | 11 +/− 0.1 | 0.01 |

The injection process substantially compensates whatever dimensional variation of the decorative body, resulting in this example in a substantially reduced dimensional variance of 0.1 mm in all three dimensions.

FIG. 10*b* illustrates how a manufacturing deviations $\delta_z$ of the tile in the z dimension can be compensated by the tile base support portion of design thickness $t_z$.

The anchoring region of the tile and coupling regions are not shown but are as discussed above with reference to other embodiments.

The foregoing description of embodiments of the present invention is not exhaustive and any update or modifications to them are obvious to those skilled in the art. Reference is made to the claims for determining the scope of the presently claimed invention.

INDUSTRIAL APPLICABILITY

The claimed invention is suitable for use in the tile manufacture and installation industry, particularly in the manufacture of interconnecting tiles in a one-step thermoplastic injection process. It is also suitable for use in providing tiles that can be used with a wide variety of interlocking materials that provide coverage of surfaces, such as wooden flooring systems and as a decorative insert.

The invention claimed is:

1. A mechanically-held composite tile comprising a tile having a durable surface, an underside and an anchoring region;

a substrate disposed proximal to the underside; and a looping member as a grout gasket extending around a periphery of the tile and mechanically engaging the anchoring region, with at least a portion of the looping member extending into contact with an engagement region of the substrate to exert a holding force on the substrate and tile, wherein an underside of the substrate further providing the engagement region which is accessed by through-channels in said substrate, and wherein a plurality of portions of said looping member comprises an interconnected underlayment structure in engagement with said engagement region.

2. The mechanically-held composite tile of claim 1, the substrate having an integral coupling region for connecting the composite tile with an adjacent coupling region.

3. The mechanically-held composite tile of claim 1, wherein one or more additional components selected from strengthening ribs, a cushioning layer, a ventilation layer, a conduit layer, an underlayer or an acoustic layer is disposed either on the underside of the durable surface or on the underside of the substrate.

4. The mechanically-held composite tile of claim 1, wherein the anchoring region of the tile is provided by one of a surface extending inwardly from an outer edge of the tile and a recess in the underside of the tile.

5. A self-grouting tile for a self-grouting tile system, each self-grouting tile comprising:

a tile portion having design dimensions of a width x, a length y, and a thickness z, and actual dimensions of a width x+δx, a length y+δy, and a thickness z+δz, where δx, δy, and δz each represent a manufacturing deviance from x, y, and z, respectively, and δx ranges from −0.01x to 0.01x, δy ranges from −0.01y to 0.01y and δz ranges from −0.05z to 0.05z, the self-grouting tile further including a mechanical anchoring region formed therein;

a tile support structure surrounding all edges of the tile portion to create a tile self-grouting portion, the tile self-grouting portion integrally formed with a tile base support portion, the tile self-grouting portion having a design width and length of tx and ty respectively such that, in the x-y horizontal plane of the tile portion a self-grouting tile design dimension is x+tx and y+ty, and due to the manufacturing deviance of the tile, the actual self-grouting portion width in the x direction is tx−δx and the actual length in the y direction is ty−δy, the tile base support portion of the tile support structure having a vertical design thickness of tz, and an actual thickness of tz−δz such that the self-grouting tile design dimensions in the x, y, and z directions are substantially achieved regardless of any manufacturing deviance of the tile; and the tile support structure self-grouting portion or the tile base support portion mechanically engaging with the tile through the mechanical anchoring region in the tile and wherein the tile support structure further including coupling regions for facilitating interconnection with adjacent self-grouting tiles.

6. A method for making a mechanically-held composite tile comprising providing a tile having a durable surface, an underside and an anchoring region;

locating the tile in a moulding apparatus, the moulding apparatus having protrusions and recesses extending laterally in a mould at the underside of the tile, said protrusions and recesses being arranged to form coupling regions in a substrate;

injecting a flowable material into said mould to form a substrate disposed proximal to the underside of the tile;

arranging said flowable material to contact said tile anchoring region to mechanically anchor the substrate directly on the tile;

injecting a flowable material into said mould to form a looping member as a grout gasket extending around a periphery of the tile and mechanically engaging the anchoring region, with at least a portion of the looping member extending into contact with an engagement region of the substrate to exert a holding force on the substrate and tile, wherein said underside of the substrate further providing the engagement region is accessed by through-channels in said substrate, and wherein a plurality of portions of said looping member comprises an interconnected underlayment structure in engagement with said engagement region.

7. A method of making a mechanically-held self-grouting tile for a self-grouting tile system comprising:

providing a tile portion having design dimensions of a width x, a length y, and a thickness z, and actual dimensions of a width x+δx, a length y+δy, and a thickness z+δz, where δx, δy, and δz each represent a manufacturing deviance from x, y, and z, respectively, and δx ranges from −0.01x to 0.01x, δy ranges from −0.01y to 0.01y and δz ranges from −0.05z to 0.05z, the self-grouting tile further including an underside and a mechanical anchoring region formed therein;

positioning the tile portion in a mould;

injecting a first flowable material into said mould, which flows into contact and mechanically engages with the anchoring region, the first flowable material solidifying into a tile support structure surrounding all edges of the tile portion to create a tile self-grouting portion, the tile self-grouting portion integrally formed with a tile base support portion, the tile self-grouting portion having a design width and length of tx and ty respectively such that, in the x-y horizontal plane of the tile portion a self-grouting tile design dimension is x+tx and y+ty, and due to the manufacturing deviance of the tile, the actual self-grouting portion width in the x direction is tx−δx and the actual length in the y direction is ty−δy, the tile base support portion of the tile support structure having a vertical design thickness of tz, and an actual thickness of tz−δz such that the self-grouting tile design dimensions in the x, y, and z directions are substantially achieved regardless of any manufacturing deviance of the tile; and the tile support structure self-grouting portion or the tile base support portion mechanically engaging with the tile through the mechanical anchoring region in the tile and wherein the tile support structure further including coupling regions for facilitating interconnection with adjacent self-grouting tiles.

8. A method according to claim 7, wherein the tile base support portion is achieved by injecting the first flowable material, which solidifies to form said support portion integrally with the tile support structure surrounding all edges of the tile portion, said support portion further comprising an integral coupling region for connecting the tile with an adjacent coupling region.

9. A method according to claim 7, wherein the support portion is placed in the mould, said support portion further comprising an engagement region and an integral coupling region, wherein during injecting the first flowable material flows into contact with said engagement region and solidifies to form the tile support structure surrounding all edges of the tile portion.

10. A method according to claim 7, wherein providing the support portion is achieved by injection of a second flowable material into the mould which solidifies to form said support portion with an integral coupling region, and further comprising substantially concurrent or consecutive injection of the first flowable material to form the tile support structure surrounding all edges of the tile portion.

11. A method according to claim 7, wherein the anchoring region of the tile is provided by one of a surface extending inwardly from an outer edge of the tile portion and a recess in the underside of the tile.

12. A method according to claim 11, wherein the anchoring region of the tile is formed by machining.

13. A method according to claim 9, wherein the tile portion is disposed directly on the support portion and the support portion has one or more through-channels through which the first flowable material flows through to the engagement region on an underside of the support portion for mechanically holding the support portion and the tile together.

14. A method according to claim 13, wherein the first flowable material flows into the through-channels and joins up to form a resilient interconnected structure disposed on the underside of the support portion.

15. A method according to claim 13, wherein the tile portion is disposed fluid-tightly on the support portion, the channels are provided in a peripheral zone of the support portion and the first flowable material flows around a peripheral region of the tile portion to form a grout gasket.

16. A method according to claim 8, further comprising forming a grout gasket from the first or second flowable material extending laterally outwardly from one or more sides of the tile portion.

17. A method according to claim 8, further comprising forming a grout gasket from the first or second flowable material at least partially encapsulating the lateral sides and the anchoring region of the tile.

18. A method according to claim 7, further comprising providing on the underside of the tile portion or support portion one or more additional components selected from the group of strengthening ribs, a cushioning layer, a ventilation layer, a conduit layer, an underlayer and an acoustic layer whilst the tile portion is in the mould.

19. A method according to claim 7, wherein a coupling region is provided on one selected from the group of at least one lateral side of the support portion and partially enclosed within an underside of the support portion.

* * * * *